US007182415B2

(12) United States Patent
Yamada

(10) Patent No.: US 7,182,415 B2
(45) Date of Patent: Feb. 27, 2007

(54) BOOKCASE AND STORAGE UNIT

(76) Inventor: Takahiro Yamada, 2412 Periwinkle Dr., Bellbrook, OH (US) 45305

( * ) Notice: Subject to any disclaimer, the term of this patent is extended or adjusted under 35 U.S.C. 154(b) by 0 days.

(21) Appl. No.: 10/905,515

(22) Filed: Jan. 7, 2005

(65) Prior Publication Data

US 2006/0152114 A1 Jul. 13, 2006

(51) Int. Cl.
*A47B 87/02* (2006.01)

(52) U.S. Cl. ..... 312/107; 312/111

(58) Field of Classification Search ..... 312/107, 312/108, 111, 257.1, 222, 139.2, 138.1, 198; 220/4.26, 4.27, 23.83, 23.86; 206/499, 503, 206/509, 511

See application file for complete search history.

(56) References Cited

U.S. PATENT DOCUMENTS 641,614 A * 1/1900 Stebbins ..... 312/249.12
2,511,949 A * 6/1950 Simon ..... 312/107
2,733,112 A * 1/1956 Dunham ..... 312/111
2,929,228 A * 3/1960 Gould, Jr. ..... 62/382
3,552,579 A * 1/1971 Simon et al. ..... 211/126.12
3,811,747 A * 5/1974 Levin ..... 312/308
4,232,916 A * 11/1980 Correia ..... 312/107
4,322,118 A * 3/1982 Shugart ..... 312/111
5,069,512 A * 12/1991 Sykes ..... 312/139.2
5,666,713 A * 9/1997 Kubota ..... 29/525.01

FOREIGN PATENT DOCUMENTS

FR 567011 * 2/1924 ..... 312/107

* cited by examiner

*Primary Examiner*—James O. Hansen
(74) *Attorney, Agent, or Firm*—R. William Graham

(57) ABSTRACT

A bookcase has a plurality of storage units, each having a pair of side panels, each said side panel having a draw catch and a latch, a top panel interconnecting each said side panel and having an outer surface which includes a first positioning member, a bottom panel interconnecting to each said side panel and having an outer surface which includes a second positioning member which is configured in a complementary manner to said first positioning member, wherein said positioning members are geometrically spatially positioned in alignment with one another, a back panel and a front panel removably disposed adjacent said side, panels, said top panel and said bottom panel such that when so disposed forms an enclosure.

6 Claims, 4 Drawing Sheets

BOOKCASE AND STORAGE UNIT

BACKGROUND OF THE INVENTION

1. Field of Invention

This invention relates to a bookcase or storage unit. More particularly, the invention relates to a bookcase having a plurality of stackable storage units which can be easily assembled and disassembled by the user without the need of tools and can be customized to fit in a given space.

2. Related Art

Aside from conventional custom built or made to fit bookcases produced through carpentry, there are numerous free standing bookcases and shelf units on the market today. Some of these come in a kit and require assembly using a tool, such as a screwdriver or wrench to install fasteners in order to hold the components of the bookcase together. This saves the manufacturer storing and shipping costs by passing on to the consumer the cost of assembling the bookcase.

There also exist knock-down bookcases and shelf units which do not require fasteners to connect together the various parts of the unit. Such bookcases are typically weak or unstable or serve only as a shelf.

A problem which owners have with existing bookcases is that during a moving situation, the existing bookcase requires relatively cumbersome breakdown wherein the books on the shelves must be removed and the bookcase shipped in disassembled or assembled form. Books need to be removed from the shelves and packed into a box and then be restored into bookshelves after moving. This adds expense and time to the task of moving. Another common problem which bookcases have is in providing a suitable adjustable height for the bookcase.

The present invention solves both of these problems of prior art by providing stackable units which convert between a storage unit and a shelf unit and also provide selective height increments. The owner can easily adjust the height and number of shelves that the bookcase contains. When needing to move the bookcase, each shelf converts to a moving box reducing the task of moving.

SUMMARY OF THE INVENTION

Accordingly, it is the object of the present invention to improve a bookcase or a storage unit.

Another object of the invention is to provide a storage furniture unit which is aesthetically pleasing.

Yet another object of the invention is to provide a quick connect storage unit which can be used as a bookcase, shelf, container or moving aid which is secure and stable.

Still another object of the invention is to provide such a bookcase which uses a minimal number of fasteners in order to secure together the units of the bookcase.

Another object is to ease moving a bookcase, wherein the bookcase includes units which are each provided with a quick connect side to form a substantially enclosed container.

Other objects will in part be obvious and will in part appear hereinafter.

Accordingly, the present invention is directed to a bookcase and storage unit. The bookcase has a stackable storage unit, which includes a first storage unit, having a left side panel and a right side panel, each the side panel having a draw catch connected to a first end thereof and a latch connected to a second end thereof, a top panel interconnecting to one end of each the side panels and having an outer surface which includes a first positioning member, a bottom panel interconnecting to another end of each the side panels and having an outer surface which includes a second positioning member which is configured in a complementary manner to the first positioning member. The positioning members are geometrically spatially positioned in alignment with one another. A back panel is disposed adjacent a first set of contiguous edges of the side panels, the top panel and the bottom panel in a manner to form a partial enclosure. A front panel is removably disposed adjacent a second set of contiguous edges of the side panels, the top panel and the bottom panel such that when so disposed forms an enclosure. The storage unit includes slide guides connected to the storage unit to receive the front panel in a slidable removable manner which can include a stop therein.

The bookcase or storage unit includes the features of construction, combination of elements, and arrangement of parts which will be exemplified in the following detailed description, and the scope of the invention will be indicated in the claims.

DETAILED DESCRIPTION OF THE PREFERRED EMBODIMENT

Figure 1:
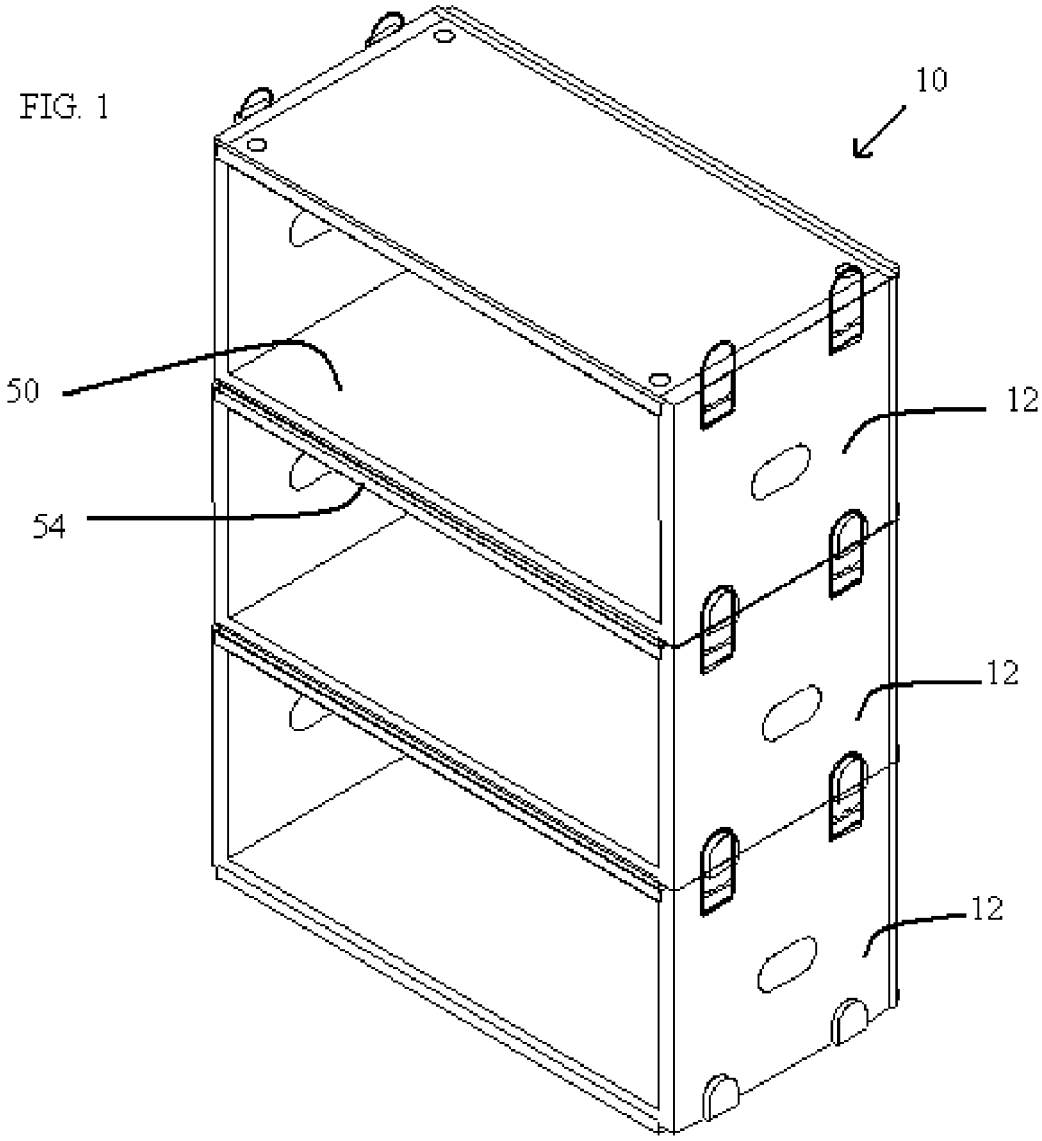
FIG. 1 is a perspective of the bookcase of the present invention.
Figure 2:
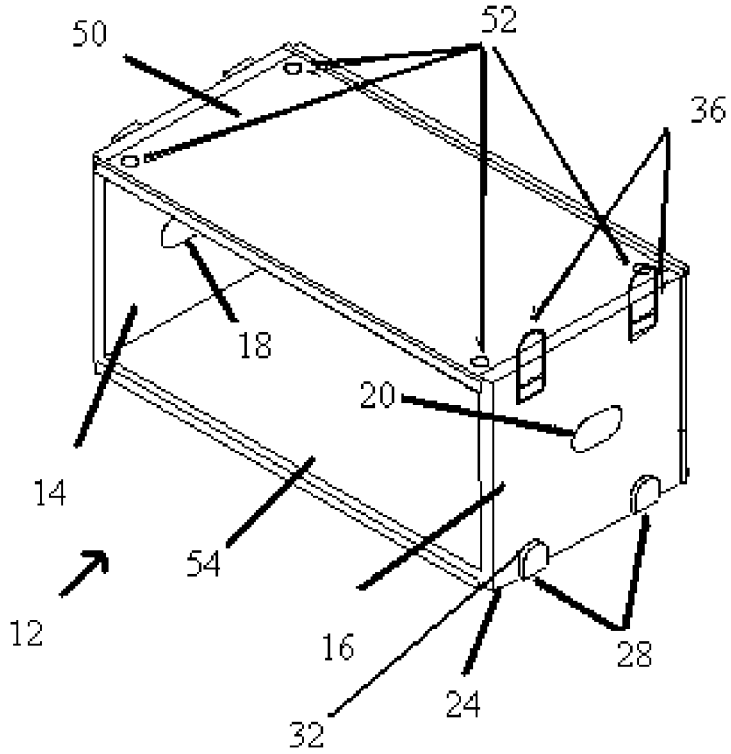
FIG. 2 is a perspective view of a storage unit of the present invention.

Referring now to the drawings, the bookcase of the present invention is generally referred to by the numeral 10 as seen in FIG. 1. The bookcase 10 can include one or more storage unit(s) 12. Each storage unit 12 includes a left side panel 14 and a right side panel 16 each having an open handle surface 18 and 20, respectively. Here, the panels 14 and 16 are shown as generally rectangular and of a like size.

Connected to a bottom end 22 and 24 of each side panel 14 and 16, respectively, are a pair of draw catches 26 and 28, respectively. Each draw catch 26 and 28 can be formed with a grooved perimeter surface 30 and 32, respectively. Additionally, each side panel 14 and 16 includes a pair of latches 34 and 36, respectively, which can preferably be longitudinally aligned with the respective draw catches 26 and 28. The draw catches 26 and 28 are formed in a like manner to one another as are the latches 34 and 36. Latch 36 includes a mounting plate 38, loop member 40 and hinge member 42 interconnecting the mounting plate 38 and loop member 40. The draw catches 26 and 28, and the latches 34 and 36, are either attached or embedded on or in the side panel 14 and 16.

The storage unit 12 includes a top panel 50 which can be fixably connected to upper ends 23 and 25 of side panels 14 and 16, respectively. The connection can be by any suitable manner known in the art, including by permanent and removable means. Formed on an outer surface of the top panel 50 are a plurality of positioning pads 52 which can be preferably be formed in a symmetrical manner thereon.

The storage unit 12 includes a bottom panel 54 which can be fixably connected to lower ends 22 and 24 of side panels 14 and 16, respectively. The connection can likewise be by any suitable manner known in the art, including by permanent and removable means. The panels 50 and 54 are shown as generally rectangular and of a like size. Formed on an outer surface of the bottom panel 54 are a plurality of positioning pad receiving surfaces 56 which can be preferably be formed in a symmetrical manner thereon and are spatially positioned such that when the outer surface of the top panel 50 is disposed adjacent the outer surface of the bottom panel 54 as illustrated in FIG. 1 the pads 52 and surface 56 are geometrically spatially positioned in alignment with one another and the pads 52 are received within the surfaces 56.

Figure 5:
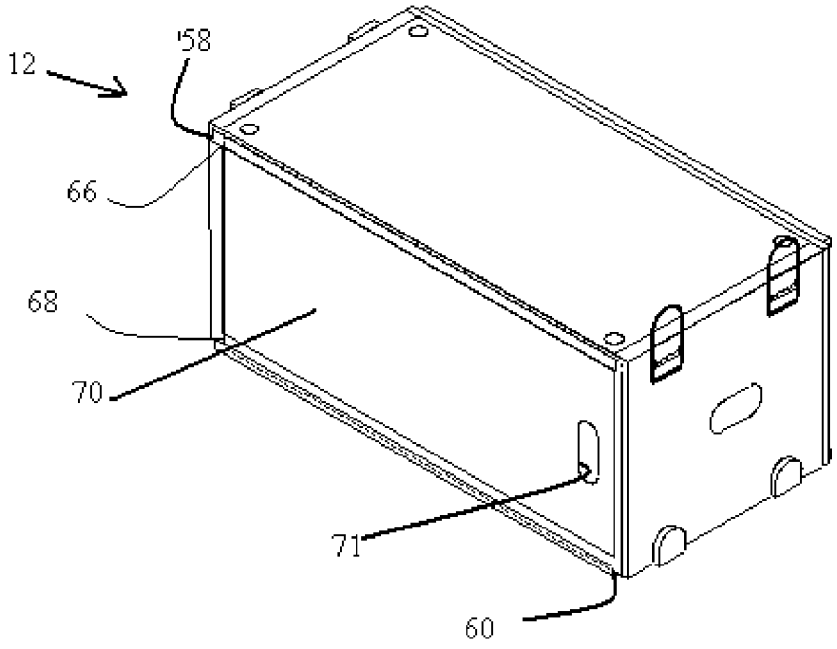
FIG. 5 is a perspective view of a storage unit of the present invention in a closed mode.
Figure 6:
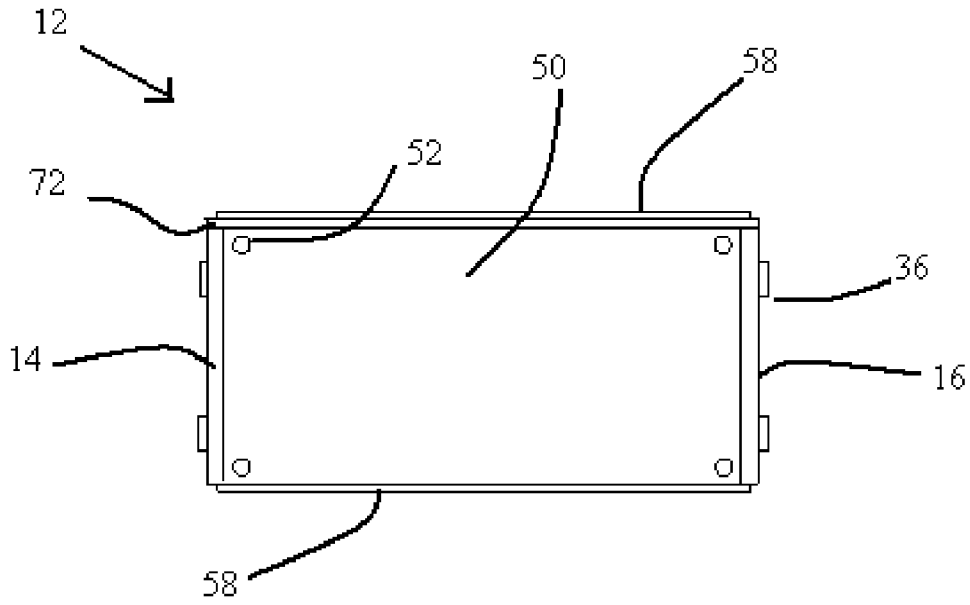
FIG. 6 is a top of a storage unit of the present invention.
Figure 7:
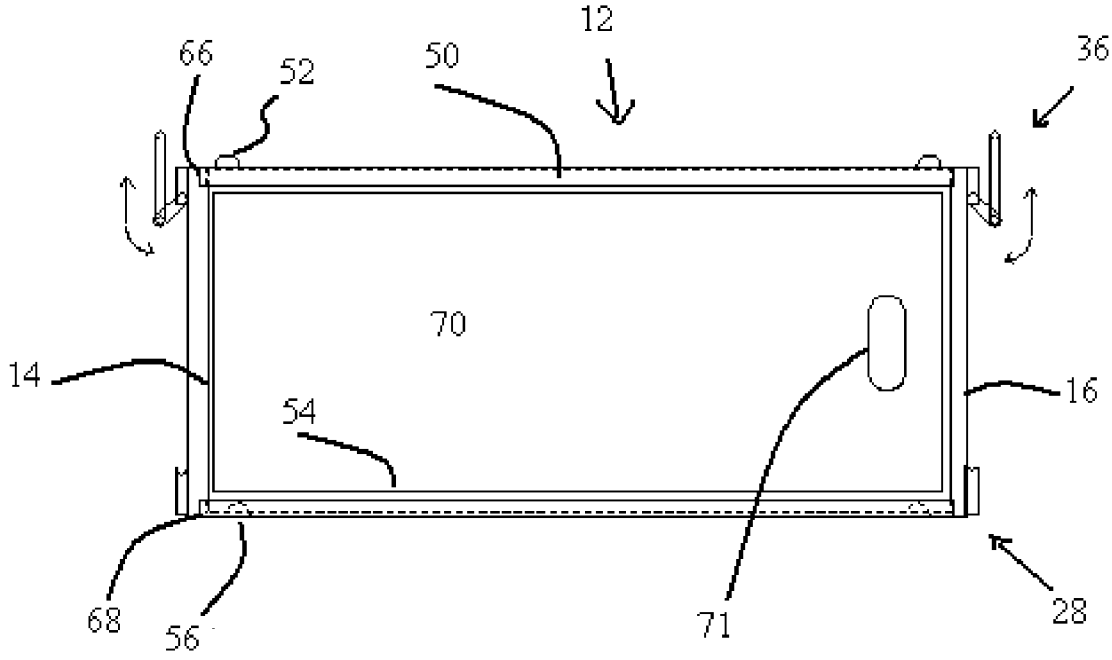
FIG. 7 is a front view of a storage unit of the present invention in a closed mode.

A pair of slide guides 58 and 60 extends along front edges 62 and 64 of top panel 50 and bottom panel 54, respectively. Stops 66 and 68 are disposed in an end of each slide guide 58 and 60, respectively. A front panel 70 can be slidably received within the slide guides 58 and 60 as seen in FIG. 5 and held against movement in one direction by the stops 66 and 68. The front panel 70 includes an open handle surface 71 to readily enable the insertion and removal of the same from the slide guides 58 and 60.

Figure 3:
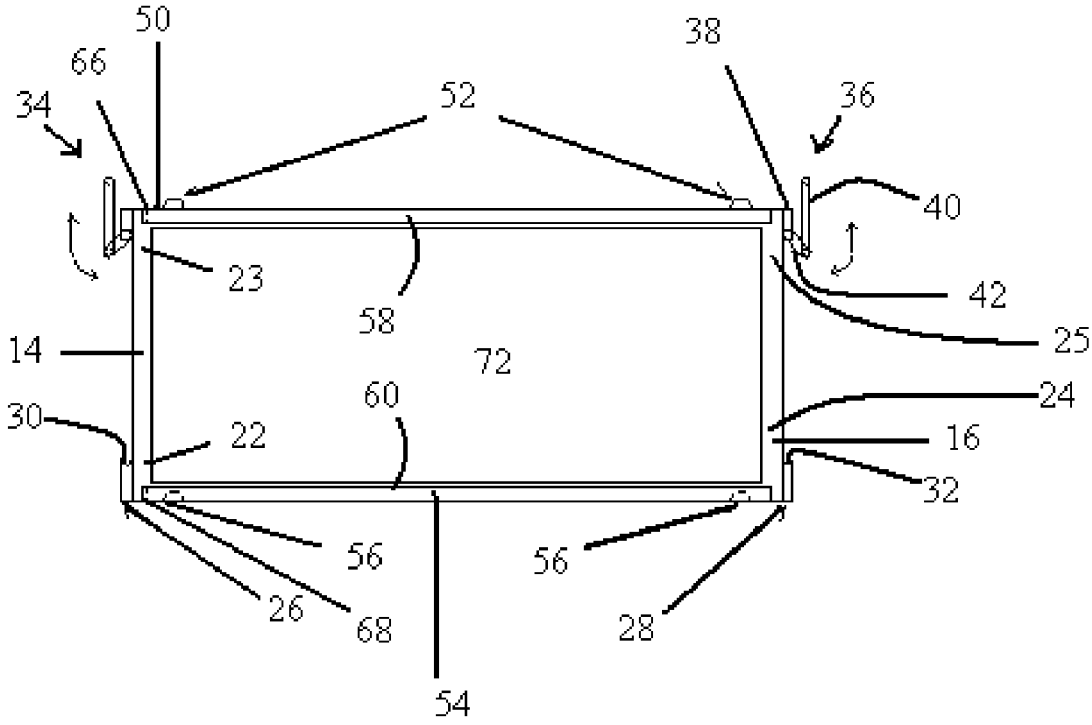
FIG. 3 is a front view of a storage unit of the present invention in an open mode.
Figure 4:
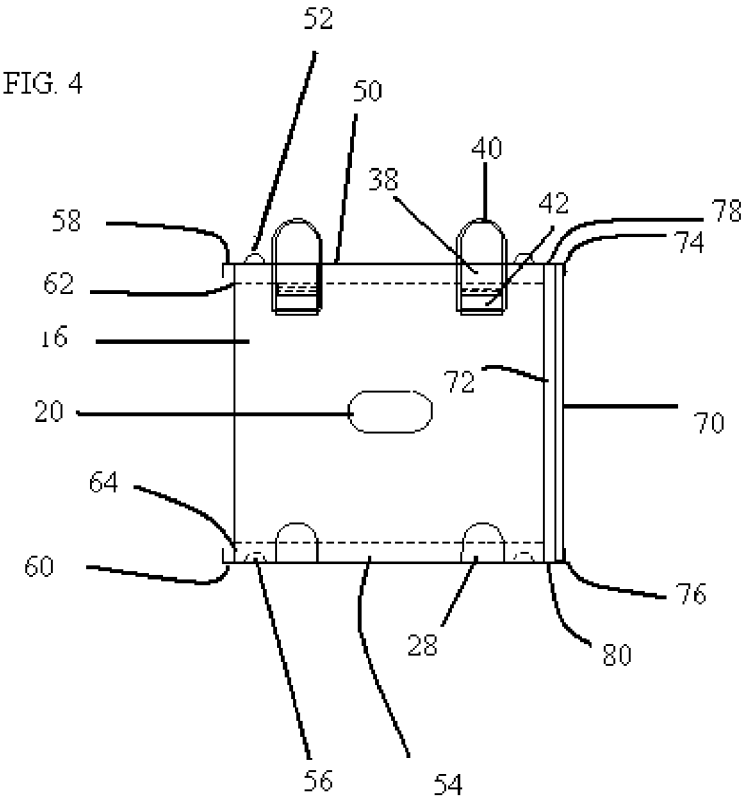
FIG. 4 is a side view of a storage unit of the present invention.

A back panel 72 is provided which can be fixably connected to panels 14, 16, 50 and 54 as seen in FIGS. 3 and 4, for example, wherein the connection can be by any suitable manner known in the art, including by permanent and removable means. The panels 70 and 72 are shown as generally rectangular and can be of a similar size. Likewise, a pair of slide guides 74 and 76 extends along edges 78 and 80 of back panel 72. Stops (not shown) can also be included in slide guides 74 and 76 in a similar manner in an end of each slide guide 74 and 76. In this regard, the front panel 70 can be slidably received within the slide guides 74 and 76 as seen in FIG. 4 and held against movement in one direction. This mode is intended principally when the storage unit 12 is used as a shelf when the front panel 70 is not in use as a moving aid or to provide a more fully enclosed storage aid.

The above described embodiment is set forth by way of example and is not for the purpose of limiting the present invention. It will be readily apparent to those skilled in the art that obvious modifications, derivations and variations can be made to the embodiment without departing from the scope of the invention. Accordingly, the claims appended hereto should be read in their full scope including any such modifications, derivations and variations.

What is claimed is:

1. A pair of stackable storage units, which comprises:

a pair of storage units in stacked relation, each storage unit having a left side panel and a right side panel which are of a first rectangular size, each said side panel having a draw catch connected to a first end thereof and a latch connected to a second end thereof wherein said side panels include an open handle surface;

a top panel interconnecting to said second end of each said side panel and having an outer surface which includes a first positioning member;

a bottom panel interconnecting to said first end of each said side panel and having an outer surface which includes a second positioning member which is configured in a complementary manner to said first positioning member, wherein said positioning members are geometrically spatially positioned in alignment with one another;

a back panel disposed adjacent a first set of contiguous edges of said side panels, said top panel and said bottom panel in a manner to form a partial enclosure;

a front panel disposed adjacent a second set of contiguous edges of said side panels, said top panel and said bottom panel, and a first set of slide guides having a first slide guide connected to said edge of said top panel of said second set of contiguous edges and a second slide guide connected to said edge of said bottom panel of said second set of contiguous edges, wherein said front panel is removably slidable within said first set of slide guides to permit insertion and removal past one of said side panels, wherein said front panel, said side panels, said back panel, said top panel and said bottom panel form an enclosure and wherein said top panel, said bottom panel, said back panel, and said front panel are generally of a second rectangular size larger than said first rectangular size; and a second set of slide guides having a first slide guide connected to a top edge of said back panel and a second slide guide connected to a bottom edge of said back panel, wherein said front panel is removably slidable within said second set of slide guides.

2. The pair of stackable storage units of claim 1, wherein an end of one of said first set of slide guides includes stop therein.

3. The pair of stackable storage units of claim 1, wherein an end of said second set of slide guides include a stop therein.

4. The pair of stackable storage units of claim 1, wherein said front panel includes an open handle surface.

5. The pair of stackable storage units of claim 1, wherein said draw catch includes a grooved perimeter surface and said latch includes a looped portion and said catch and said latch are in a generally vertical alignment.

6. The pair of stackable storage units of claim 1, which includes a plurality of said first positioning members on said top panel and a plurality of said second positioning members on said bottom panel.

* * * * *